US009927196B2

(12) United States Patent
Bitsack

(10) Patent No.: US 9,927,196 B2
(45) Date of Patent: Mar. 27, 2018

(54) CHAMBER SAFETY DEVICE

(71) Applicant: Chamber View, LLC., Nashua, NH (US)

(72) Inventor: Ned T. Bitsack, Nashua, NH (US)

(73) Assignee: X-RING PRODUCTIONS LLC., Hamburg, PA (US)

( * ) Notice: Subject to any disclaimer, the term of this patent is extended or adjusted under 35 U.S.C. 154(b) by 0 days.

(21) Appl. No.: 15/589,420

(22) Filed: May 8, 2017

(65) Prior Publication Data

US 2018/0045480 A1 Feb. 15, 2018

Related U.S. Application Data

(63) Continuation-in-part of application No. 14/493,913, filed on Sep. 23, 2014, now abandoned, which is a continuation-in-part of application No. 13/534,437, filed on Jun. 27, 2012, now Pat. No. 8,857,092.

(60) Provisional application No. 61/590,019, filed on Jan. 24, 2012, provisional application No. 61/501,325, filed on Jun. 27, 2011.

(51) Int. Cl.
*F41A 17/44* (2006.01)
*F41A 29/04* (2006.01)

(52) U.S. Cl.
CPC ..... *F41A 17/44* (2013.01); *F41A 29/04* (2013.01)

(58) Field of Classification Search
CPC ..... F41A 17/44
USPC ..... 42/70.11, 83, 85, 70.01, 90, 106, 96
See application file for complete search history.

(56) References Cited

U.S. PATENT DOCUMENTS

| | | | | |
|---|---|---|---|---|
| 1,537,517 A * | 5/1925 | Wheeling | F41A 35/04 | 42/96 |
| 2,557,277 A * | 6/1951 | Gibson | F41A 29/00 | 42/96 |
| 4,835,894 A * | 6/1989 | Libassi | F41A 17/44 | 42/70.11 |
| 5,097,613 A * | 3/1992 | Miller | F41A 17/44 | 42/1.05 |
| 6,250,008 B1 * | 6/2001 | Silver | F41A 17/44 | 42/70.01 |
| 6,470,615 B1 * | 10/2002 | Peterken | F41A 17/44 | 42/70.01 |
| 7,891,129 B2 * | 2/2011 | Parry, Jr. | F41A 35/02 | 42/96 |

* cited by examiner

*Primary Examiner* — Reginald Tillman, Jr.

(57) ABSTRACT

A chamber safety device is configured to be inserted into one or more openings of a weapon, such as the loading/ejection port(s) or barrel of a shotgun, rifle or handgun. When the chamber safety device is inserted into the one or more opening(s), the weapon is not capable of firing and/or being loaded with ammunition due to the fact that no bullet or shell can be inserted into the firing chamber and/or the weapon firing mechanism cannot come in contact with a bullet or shell located in the firing chamber. At least a portion of the chamber safety device is designed to extend outwardly from breach of the weapon and is colored in a high visibility color such that those nearby can visually detect the presence of the chamber safety device inserted in a weapon.

7 Claims, 21 Drawing Sheets

200

CHAMBER SAFETY DEVICE

CROSS-REFERENCE TO RELATED APPLICATIONS

This application is a Continuation-In-Part of U.S. patent application Ser. No. 14/493,913, which was filed on Sep. 23, 2014 entitled, "Chamber Safety Device", which is a Continuation-in-Part of U.S. patent application Ser. No. 13/534,437, which was filed on Jun. 27, 2012 entitled "Chamber Safety Device", which in turn claims priority to U.S. Provisional Patent Application No. 61/590,019 filed on Jan. 24, 2012 entitled "Chamber Safety Device" and 61/501,325 filed on Jun. 27, 2011 all of these applications which are incorporated fully herein by reference.

TECHNICAL FIELD

The present invention relates to safety devices for weapons and more particularly, relates to a device that is inserted into the chamber of a weapon, thereby insuring that no weapon shell or ammunition is in the chamber thereby preventing accidental firing of the weapon as well as providing a visual safety indicator that indicates that the chamber is empty and that the weapon cannot be fired.

BACKGROUND INFORMATION

Traditional manual load shot guns (as well as rifles) typically are provided in one of two types. The first type is an auto-loading weapon where the firing chamber is built into the side of the firearm and the firearm does not "break-open" while the second type is the break open weapon, where the barrel and firing chamber can be "broken" or opened, such that the weapon cannot be fired in that position.

Users of these weapons at public/private locations, such as gun clubs, shooting preserves, and other shooting locations, must walk around with their weapons either unloaded or broken open. Many shotgun versions, such as the autoloaders type including pump action shotguns, riot shotguns, lever action shotguns or other semi-automatic shotguns do not break open and therefore it is difficult or almost impossible to tell from a distance if the weapon is loaded and capable of firing or unloaded. As a result, these weapons are often not permitted at shooting locations because safety cannot be assured. These newer types of shotguns that do not break open are becoming increasingly popular among young, female and smaller stature shooters because of less recoil.

Users of a break-open style weapon typically walk around with their weapon in the "broken-open" position so that everyone can tell the weapon is either not loaded and/or not capable of firing. Keeping the weapon in an open state serves as the equivalent of engaging a safety mechanism on a weapon, but also gives the added assurance to people in view who can see the broken open position of the weapon, but who cannot visually see the safety engaged from a distance.

These break-action style double loading shotguns exist in two general subtypes. First, the traditional side-by-side shotgun, which features two barrels mounted one beside the other and second, the over and under shotgun, which features two barrels, with one mounted on top of the other. Both types have been used for both hunting and sporting purposes.

A loaded and ready to fire weapon is dangerous and accordingly, most shooting locations have specific rules that require that the weapon is unloaded and action opened when moving around the facility. For example, the facility may require that when not in the firing stand, that the action of the weapon must be open and empty. This can be easily and quickly accomplished and verified with traditional "break-open" shotgun models, whereby a user can unload and break open the weapon.

Accordingly, there is a need to find a way of using the new autoloader type of shotguns (rifles or other similar weapons) at shooting locations while also ensuring that everyone is aware that the gun cannot be fired. The solution should be cost effective, simple to use and serve as an obvious indicator that the weapon is not capable of being fired. Additionally, the solution should also be readily useable in more traditional shotguns that break open.

SUMMARY

The invention features a chamber safety device that comprises an upper portion with a length and a width, a lower portion with a length and a width, wherein the length of the lower portion is shorter than the length of the upper portion and wherein the width of the lower portion is narrower than the width of the upper portion, wherein the lower portion is configured to make a snug friction fit inside an opening of a weapon and the upper portion includes a top cover region. The opening of the weapon is a port through which bullets or shells are inserted and ejected.

The top cover region may be colored in a high visibility color. The top cover region may be colored a hunter orange color.

In the preferred embodiment, the chamber safety device is entirely molded as a single piece of material such as silicone. Silicone is somewhat resilient, easy to mold and EECO friendly. In another embodiment, the top cover region may be constructed from a hard plastic material. In all embodiments, the top cover region may extend beyond a top surface of the upper region in one or more directions, thereby creating a lip, and wherein the lip is configured to allow a user to grip the chamber safety device for removal of the chamber safety device from the opening of the weapon and insertion of the chamber safety device into the opening of the weapon.

The upper portion may have a bulbous shape or a handle shape or a grip shape. In another embodiment, the upper portion may be constructed from a hard foam material.

In another embodiment, the lower portion may be constructed from a resilient foam material. The lower portion may include a material configured to retain a lubricant.

In another alternate embodiment of the present invention, a chamber safety device for a two opening weapon, the chamber safety device comprises an upper portion with a length and a width, wherein the upper portion includes a top cover region, a first lower portion connected to the upper portion and configured to make a snug or friction fit inside a first opening of a weapon and a second lower portion connected to the upper portion and configured to make a snug fit inside a second opening of a weapon, the second opening of the weapon disposed alongside and proximate the first opening. The first and second openings may be disposed side-by-side on the weapon or the first and second openings may be disposed one over the other on the weapon.

The first lower portion and the second lower portion may each include a bulbous or rounded shape. The first lower portion and the second lower portion may be constructed from one of the following: silicone (preferably) or alternatively from a resilient foam material, open cell foam, closed cell foam, rubber, or a composite material. The first lower portion and the second lower portion may include a material configured to absorb and retain a lubricant.

The upper portion may have a bulbous shape or a handle shape or a grip shape. The upper portion may be constructed from a hard foam material.

The top cover region may be colored in a hunter orange color or another high visibility color. The top cover region may be constructed from a hard plastic material. The top cover region may extend beyond a top surface of the upper region in one or more directions, thereby creating a lip, wherein the lip is configured to allow a user to grip the chamber safety device for removal of the chamber safety device from the openings of the weapon and insertion of the chamber safety device into the openings of the weapon.

In another embodiment the invention features a chamber safety device for an opening in or proximate a breech in a weapon, wherein the weapon includes an action movable from an open non-armed position to a closed armed position. The chamber safety device comprises an upper portion having a length and a width. The upper portion is configured for extending conspicuously out of and to the exterior of an opening of a weapon proximate a breech of the weapon, such that at least the upper portion remains continuously conspicuous to others in the area of the weapon proximate said breech when the chamber safety device is inserted into the opening in the weapon. The upper portion has a shape that is typically selected from the shapes consisting of a bulbous shape, a handle shape and a grip shape, and wherein at least a top region of the upper portion is colored in a high visibility color. The high visibility color typically has a wavelength of greater than 492 nm.

The invention also features a lower portion having a length and a width, wherein the lower portion is configured for frictionally engaging with the opening of the weapon proximate the breech of the weapon without mechanical actuation, and wherein in use, the lower portion is configured for preventing the weapon action from moving from the open non-armed position to the closed armed position and for preventing a weapon ammunition round from being inserted into the breech.

The invention also features an intermediate portion, disposed between the upper portion and the lower portion. The intermediate portion has a length and a width. The length of the intermediate portion is longer than the length of the upper portion and the lower portion, and wherein the width of the intermediate portion is wider than the width of the upper portion and the lower portion.

In yet another embodiment, the invention features a chamber safety device for a two opening weapon. The two openings are located in or proximate a breech in a weapon. The weapon includes an action movable from an open non-armed position to a closed armed position. The chamber safety device comprises an upper portion having a length and a width. The upper portion is configured for extending conspicuously out of and to the exterior of an opening of a weapon proximate a breech of the weapon, such that at least the upper portion remains continuously conspicuous to others in the area of the weapon proximate the breech when the chamber safety device is inserted into the opening in the weapon. The upper portion generally has a shape selected from the shapes consisting of a bulbous shape, a handle shape and a grip shape, and wherein at least a top region of the upper portion is colored in a high visibility color having a wavelength of greater than 492 nm.

The invention also includes a lower portion having a length and a width. The lower portion includes a first lower portion segment connected to the upper portion and configured to make a friction fit inside a first opening of a weapon without mechanical actuation. A second lower portion segment is connected to the upper portion and extends generally parallel to the first lower portion and is configured to make a friction fit inside a second opening of a weapon without mechanical actuation.

The second opening of the weapon is disposed alongside and proximate the first opening, and wherein in use, the first and second lower portion segments are configured for preventing the weapon's action from moving from the open non-armed position to the closed armed position and for preventing a weapon ammunition round from being inserted into the breech.

An intermediate portion is disposed between the upper portion and the lower portion. The intermediate portion has a length and a width, wherein the length of the intermediate portion is longer than the length of the upper portion and the lower portion, and wherein the width of the intermediate portion is wider than the width of the upper portion and the lower portion.

In yet another embodiment, the invention features a chamber safety device for an opening in or proximate a breech in a weapon. The weapon includes an action movable from an open non-armed position to a closed armed position and a barrel having a predetermined diameter. The chamber safety device comprises a barrel plug having a first end and a second end and an intermediate portion disposed between the first end and the second end. The intermediate portion has a diameter which is approximately the same as or slightly smaller than the predetermined diameter of the barrel. The first end also includes a tapered region having a diameter which is smaller than the diameter of the barrel, and wherein the first end includes a concave front surface perpendicular to a longitudinal access of the barrel plug.

The second end of the barrel plug has a tapered region having a diameter which is larger than the diameter of the weapon barrel. The second end includes a concave surface perpendicular to the longitudinal axis of said barrel plug, and wherein the second end of the barrel plug is configured for frictionally engaging with the weapon barrel proximate the breech of the weapon without mechanical actuation. In use, the barrel plug is configured for preventing a weapon ammunition round from being inserted into the breech of the weapon.

In another embodiment, the present invention features a chamber safety device for an opening in or proximate a breech in a semi-automatic weapon. The semi-automatic weapon includes a slide portion movable from a first position to a retracted position, a hand grip portion and a barrel having a predetermined diameter. The chamber safety device comprises a first portion configured for being inserted in one of the semi-automatic weapon barrel or an open breech region of the weapon.

An elongated elastic member having a first end is attached to the first portion. A fixed portion is attached to one of the semi-automatic slide portion or the weapon hand grip portion. The fixed portion includes one or more elastic holding devices configured for anchoring a second end of the elastic to the weapon slide portion or the weapon hand grip portion.

It is important to note that the present invention is not intended to be limited to a system or method which must satisfy one or more of any stated objects or features of the invention. It is also important to note that the present invention is not limited to the preferred, exemplary, or primary embodiment(s) described herein. Modifications and substitutions by one of ordinary skill in the art are considered to be within the scope of the present invention.

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENTS

The present invention features a chamber safety device 10, FIGS. 1, 2, 3 and 4. The chamber safety device 10 is configured to be inserted into an opening 20 (120) (typically called a chamber) of a weapon 22 (122) such as, for example, a shot gun. The opening 20 (120) is the port through which bullets/shells are inserted and ejected. When the chamber safety device 10 of according to the present invention is inserted into the opening 20/120, the weapon is not capable of firing because no live round can be inserted into the weapon's firing chamber or if a live round has inadvertently been placed or left in the chamber due to advanced loading or a misfire, the chamber bolt (firing mechanism) cannot be moved into a firing position. Additionally, because of the coloration of at least the top-most exterior region or portion 18 (118) of the chamber safety device 10, the present invention provides a visual indicator to the user and other people around the user that the weapon is not capable of firing.

Figure 1:
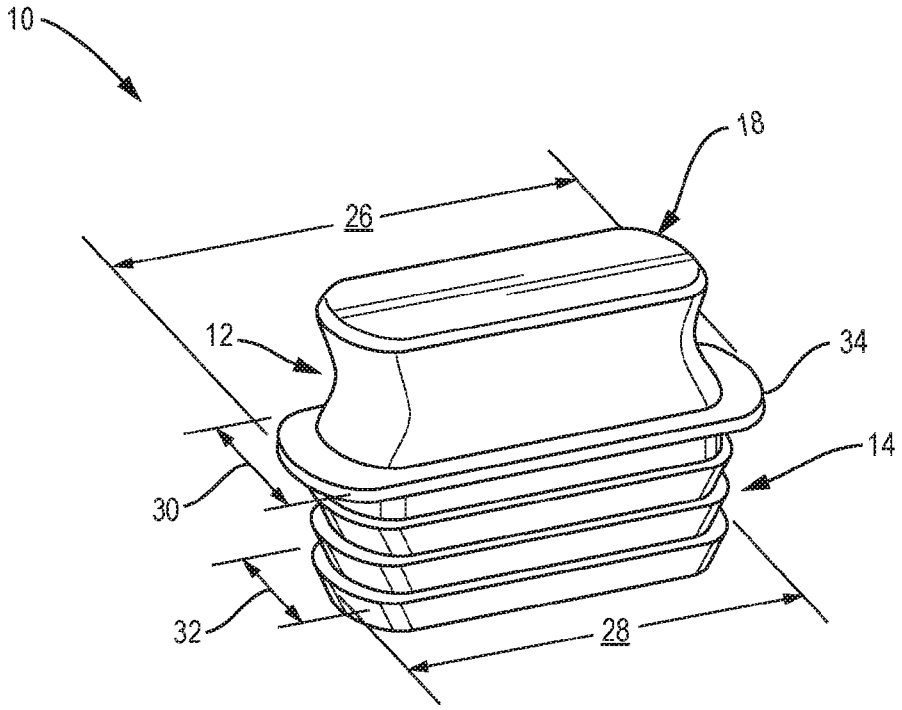
FIG. 1 is a plan view of the chamber safety device according to a first embodiment of the present invention.
Figure 2:
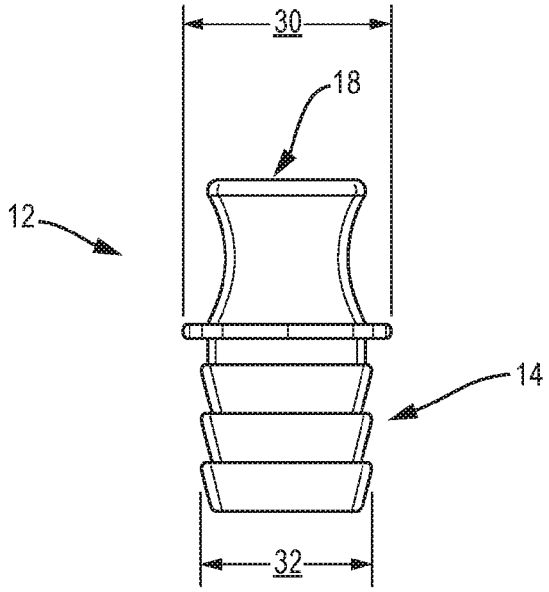
FIG. 2 is a detailed view of the width side of the chamber safety device according to a first embodiment of the present invention.
Figure 3:
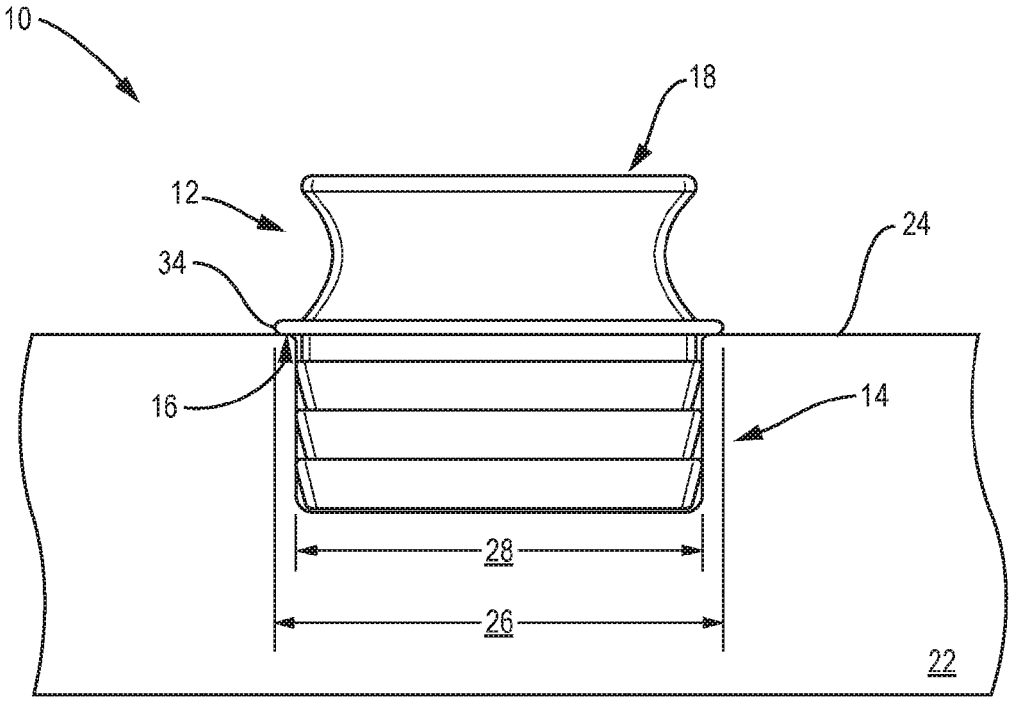
FIG. 3 is a cross-sectional side view of the length side of the chamber safety device in place in a weapon chamber according to the first embodiment of the present invention.
Figure 4:
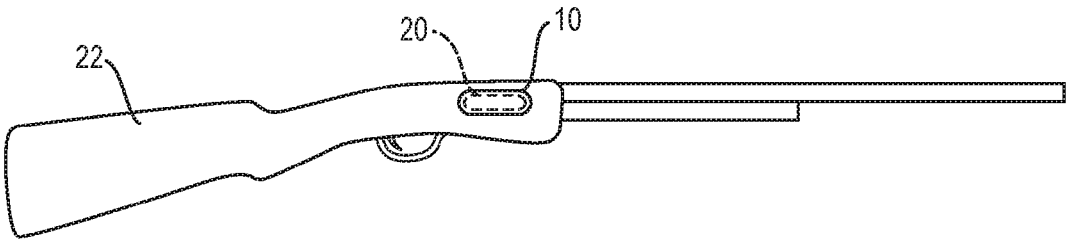
FIG. 4 is a side view of a chamber safety device in use on a shotgun according to a first embodiment of the present invention.

The chamber safety device 10 includes an upper portion 12 and a lower portion 14. The lower portion 14 preferably features a stepped (shown) or alternately a bulbous shape that is preferably configured in size to be slightly larger than the opening 20 in the weapon. In use, the larger size of the lower portion 14 in relation to the opening 20 allows for a snug and secure friction fit and retention of the lower portion 14 (and therefore the safety device 10) in the opening 20. The upper portion 12 may also feature a bulbous shape or may be more like a "handle" or "grip" shape as shown in FIG. 1.

Where the upper and lower portions 12/14 meet, the upper portion features a length 26 and a width 30 and the lower portion 14 features a length 28 and a width 32. The length 26 of the upper portion 12 is longer than the length of 28 of the lower portion 14. The width 30 of the upper portion 12 is wider than the width 32 of the lower portion 14. The greater length 26 and width 30 of the upper portion 12 prevents the upper portion 12 from entering into the opening 20. The larger length 26 and width 30 of the upper portion 12 also creates a lip 16 on the upper portion 12, which comes into contact with a top surface 24 of the weapon 22.

The upper and lower portions 12/14 are preferably constructed from one piece of material, such as silicone, or may be two separate portions that are adhered or otherwise connected to one another. At least the lower portion is preferably constructed from a generally resilient material, such as silicone or open or closed cell foam.

In the preferred embodiment, the top portion 12 is molded as one piece with the lower portion 14. In another embodiment, the upper portion may be constructed from a hard foam or other similar material that allows the chamber safety device 10 to be gripped and inserted and removed from the opening 20 of the weapon. In another embodiment, the upper portion may feature a separate top cover portion 18. The top cover portion 18 may be a separate hard plastic or other similar material. At least the top cover portion 18 is preferably "hunter' orange or another bright color that allows the top cover portion 18, which is exposed and visible when in use and in place in the opening 20 of the weapon, to be seen from a great distance. The top cover portion 18 is configured to cover a top surface of the upper portion and may extend beyond the top surface of the upper portion.

The upper portion 12 and/or the top cover portion 18 may feature one or more panels or flattened surface areas, which may feature a name, logo or other brand or marketing identifier. For example, the top cover portion 18 may feature one of these panels in a central part of an upper surface of the top cover portion 18. An etched or pronounced texture may surround the panel.

The material of the lower portion may feature a light texture. The lower portion 14 may also be coated with a lubricant. The material of the lower portion 14 provides a medium for the lubricant to be placed and retained for internal protection of the firearm chamber in wet weather conditions. The lubricant will both enable the lower portion 12 to move easily in and out of the opening 20 and will also serve to lubricate the inside of the opening (insertion and ejection port) 20 of the weapon 22.

When in use, lubricant on the lower portion 14 of the chamber safety device 10 also serves to prevent water and debris, such as dirt, from entering the opening 20 of the weapon 22 and from adhering to the chamber safety device 10, while also offering moisture protection in damp or moist weather conditions. The lubricant may be a typical gun lubricant. Lip 34 also serves to prevent water and debris, such as dirt, from entering the opening 20 of the weapon 22.

Figure 5:
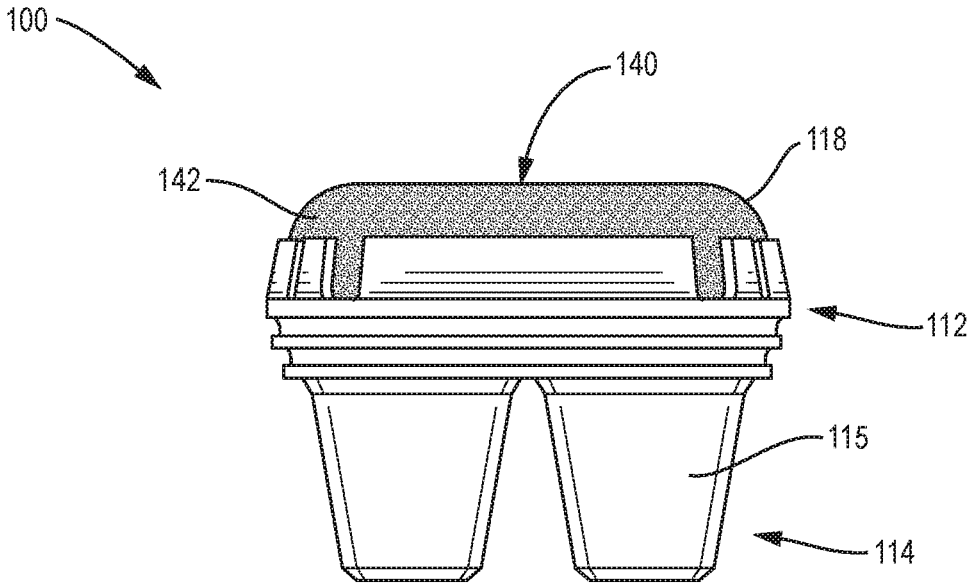
FIG. 5 is a detailed view of the chamber safety device according to a second embodiment of the present invention.
Figure 6:
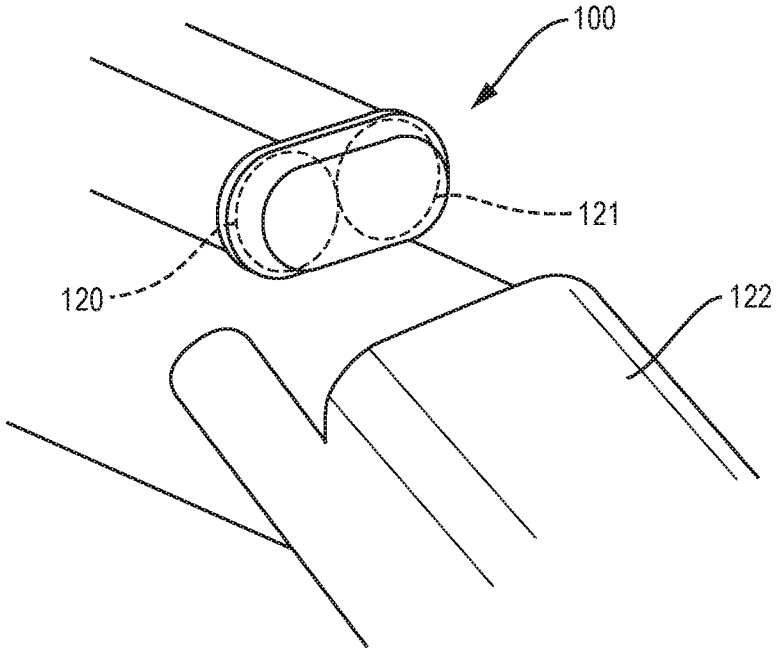
FIG. 6 is a view of the chamber safety device in a weapon chamber of a side-by-side break action shotgun according to the second embodiment of the present invention.

In another embodiment of the present invention as shown in FIGS. 5 and 6, the chamber safety device 100 is designed and configured for use in a break-action shotgun. The chamber safety device 100 can be inserted either horizontally in a side-by-side shotgun configuration (as shown in FIG. 5) or vertically in an over and under shotgun (not shown). The chamber safety device 100 provides an additional level of security above and beyond the shotgun being broken open, by providing a visual indication that the weapon does not contain ammunition and is not capable of firing.

In this second embodiment, the chamber safety device 100 is configured to be inserted into the two openings 120/121 of a weapon 122. When a break action shotgun is broken open, two ammunition compartments or openings 120/121 are exposed. When the chamber safety device 100 is inserted into the openings 120/121, the weapon 122 is not capable of firing because no live round can be inserted into the weapon's firing chamber. Additionally, because of the coloration of an exterior region or top cover portion 118 of the chamber safety device 100, the present invention provides a visual indicator to the user and other people around the user that the weapon is not capable of firing.

The chamber safety device 100 includes an upper portion 112 and two lower portions 114/115. The lower portions 114/115 feature a bulbous shape or round shape. The shape and size of each of the lower portions 114/115 is preferably configured in size to be slightly larger than each of the openings 120/121. In use, the larger size of the lower portions 114/115 in relation to the openings 120/121 allows for a snug and secure friction fit and retention of the lower portions 114/115 in the openings 120/121. The upper portion 112 may also feature a bulbous shape or may be more like a "handle" or "grip" shape. The upper portion 112 may feature a larger length and width than the combined length and width of the lower portions 114/115, as previously described in conjunction with the first embodiment of the present invention; however this is not intended to be a limitation of the present invention.

The upper portion 112 and lower portions 114/115 may be constructed from one piece of material or may be two or three or more separate portions that are adhered to one another. The lower portion 114/115 may be constructed from a generally resilient foam material, such as open or closed cell foam, or a rubber or other composite material. The material of the lower portion may feature light texture. The upper portion 112 and/or the top cover portion 118 may be constructed from a hard foam material or other similar material that allows the chamber safety device 100 to be gripped and inserted and removed from the openings 120/121 of the weapon 122. The upper portion may feature smooth surfaces. The top cover portion 118 may feature a separate hard plastic or other similar material. The top cover portion 118 is preferably "hunter" orange or another bright color that allows the top cover portion 118, which is exposed and visible when in use and in place in the openings 120/121 of the weapon, to be seen from a great distance. The top cover portion 118 may feature extended side portions (not shown) that extend lengthwise past the length of the upper portion 112, which facilitate removal of the chamber safety device 100 from the openings 120/121 by providing a grip surface. The lower portions 114/115 may also be coated in or impregnated with a lubricant.

The upper portion 112 and/or the top cover portion 118 may feature one or more panels or flattened surface areas 140, which may feature a logo or other identifier. For example, the top cover portion 18 may feature one of these panels 140 in a central part of an upper surface of the top cover portion 18. An etched or pronounced texture portion 142 may surround the panel.

Figure 7D:
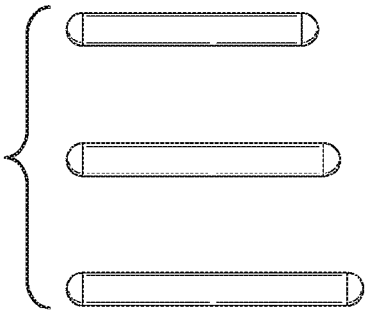
FIGS. 7A-7F illustrate a chamber safety device according to an additional embodiment of the invention.
Figure 7F:
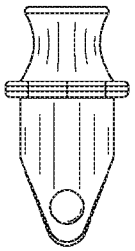
Figure 7B:
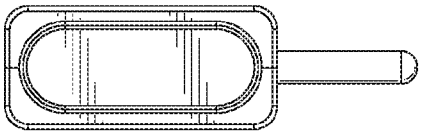
Figure 7A:
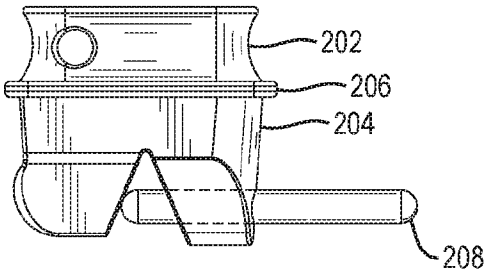
Figure 7E:
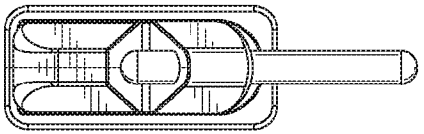
Figure 7C:
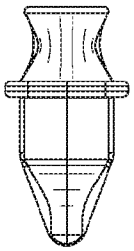

In another embodiment of the chamber safety device 200, FIGS. 7A-7F according to the present invention, the chamber safety device 200 includes in upper portion 202, a lower portion 204, and intermediate portion 206 and a barrel insert 208 which protrudes from the lower portion 204 as shown more clearly in FIG. 7E. The barrel insert 208 may be of various lengths as shown in FIG. 7D and of various diameters to accommodate the interior diameter of the barrel of the weapon in which the chamber safety device is to be inserted. One feature of this embodiment of the chamber safety device 200 of the present invention is that the barrel insert 208 may be inserted into the barrel of a weapon, through the breech, which helps secure the chamber safety device 200 in place in the breech.

The barrel insert 208 is designed to be replaceable and/or slidable within the chamber safety device 200 and thus, a user may adjust the length of the barrel portion 208 in the field.

As in the previous embodiments described above, the present embodiment includes and intermediate portion 206. The intermediate portion 206 is disposed between the upper portion 202 and the lower portion 204. The intermediate portion 206 has a length and a width. The length of the intermediate portion is longer than the length of the upper portion and the lower portion, while the width of the intermediate portion is wider than the width of the upper portion and the lower portion.

Figure 8B:
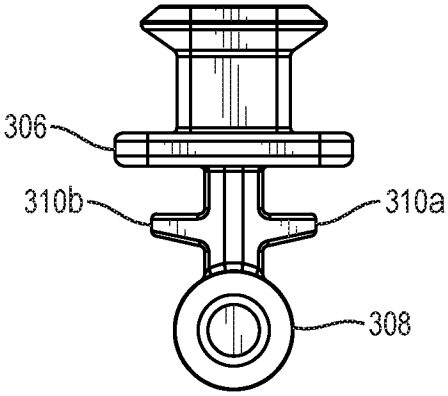
FIGS. 8A-8C illustrate a chamber safety device according to yet another embodiment of the present invention.
Figure 8C:
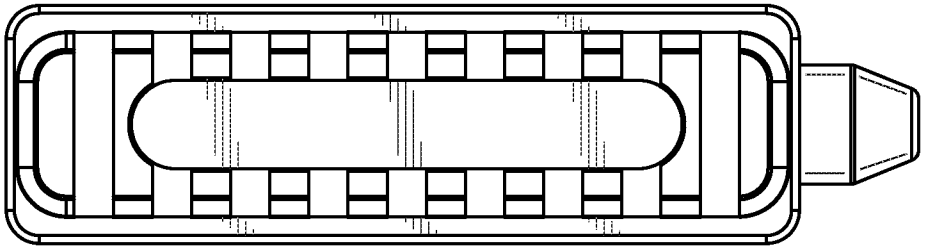
Figure 8A:
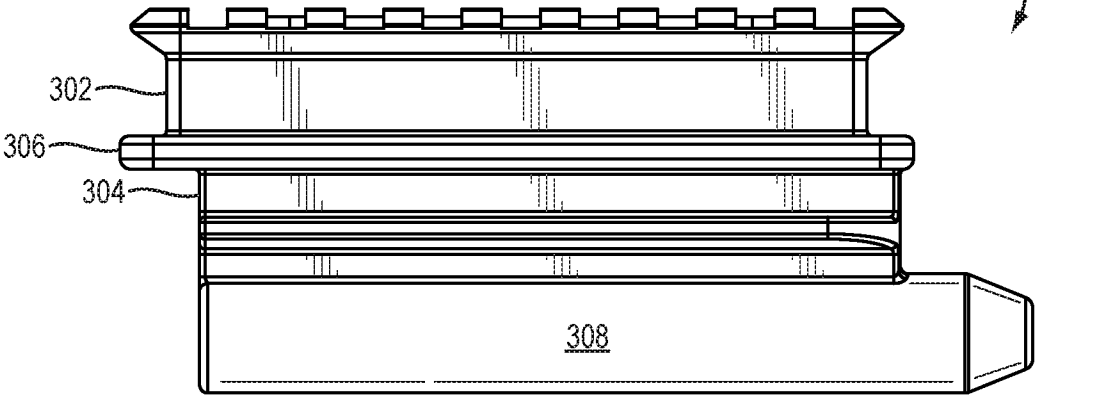
Figure 9D:
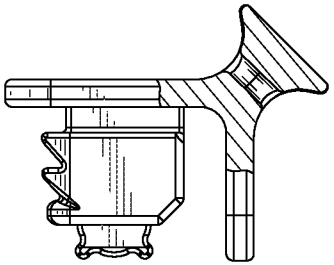
FIGS. 9A-9E illustrate yet another embodiment of the chamber safety device according to the present invention.
Figure 9E:
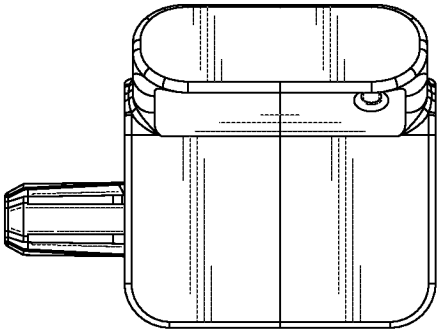
Figure 9C:
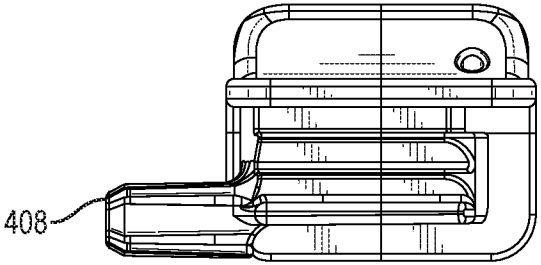
Figure 9A:
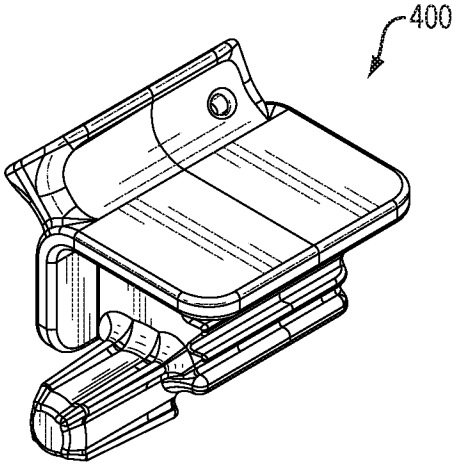
Figure 9B:
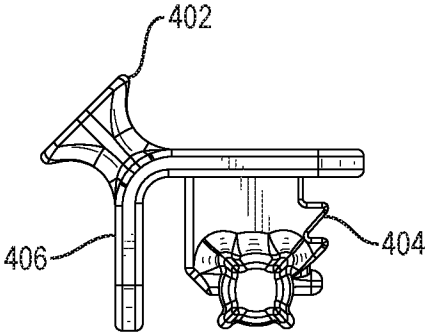
Figure 10C:
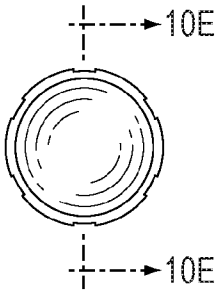
FIGS. 10A-10E illustrate yet an additional embodiment of the barrel safety device according to one embodiment of the invention.
Figure 10E:
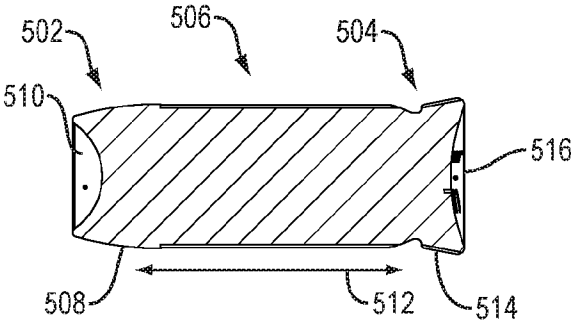
Figure 10D:
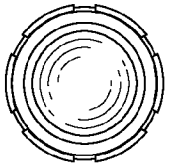
Figure 10A:
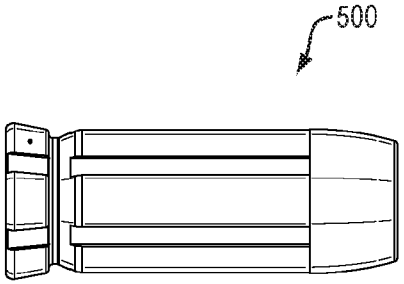
Figure 10B:
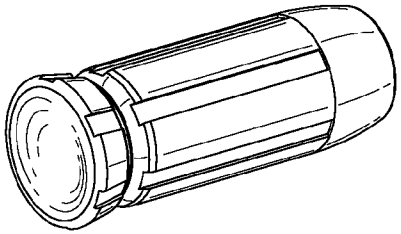

In yet another embodiment of the chamber safety device 300, FIGS. 8A-8C according to the present invention, the chamber safety device 300 includes and upper portion 302 a lower portion 304 and an intermediary portion 306 all as described above. In this embodiment, a barrel insert portion 308 is secured at or proximate a lower end of the lower portion 304. The barrel insert portion 308 is fixed in position and not interchangeable. In this embodiment, the lower portion 304 includes a region approximately midway between the barrel insert portion 308 and the intermediary portion 306 which includes first and second horizontally oriented fins 310*a*, 310*b* which serves to spring out under the undercut edges of the ejection port opening and provide mechanical retention of the device in the ejection port.

In yet an additional embodiment of the chamber safety device according to the present invention, a chamber safety device 400, FIGS. 9A-9E is illustrated. This embodiment, constructed similarly to the previous embodiments, includes an upper portion 402, a lower portion 404 and an "L" shaped intermediary portion 406. This design is better suited for automatic handguns. A barrel insert portion 408 is also provided which allows the chamber safety device 400 to be securely inserted in the barrel of a weapon. The L-shaped intermediary portion 406 of this embodiment is particularly well-suited for a horizontal and vertical alignment stop, as well as a seal of the weapon's ejection port.

In yet another embodiment of the present invention, the chamber safety device features a barrel plug 500, FIGS. 10A-10E. The barrel plug has a first end 502, a second end 504, and an intermediate portion 506 disposed between the first end 502 and the second end 504. The intermediate portion 506 has a diameter which is approximately the same as or slightly smaller than the predetermined diameter of the barrel into which the barrel plug is to be inserted.

The first end 502 of the barrel plug includes a tapered region 508 having a diameter which is, at its end point, initially less than the diameter of the barrel into which the plug is to be inserted and which tapers outwardly to match the diameter of the intermediary portion 506. The first end 502 also includes a concave front surface 510 which is perpendicular to a longitudinal axis 512 of the barrel plug.

The second end 504 of the barrel plug 500 has a tapered region 514 having a diameter which begins at approximately the same diameter as the intermediary portion 506 in increases in diameter until the diameter of the end portion of the tapered region 514 is larger than the diameter of the intermediary portion 506. The second end 504 includes a concave surface 516 perpendicular to the longitudinal axis of the barrel plug 500. The second end 504 of the barrel plug 500 is configured for frictionally engaging with the weapon barrel into which it is inserted proximate the breech of the weapon, without mechanical actuation, and wherein in use, the barrel plug is configured for preventing a weapon ammunition round from being inserted into the breech of the weapon.

The barrel plug 500 according to the present invention is sized and shaped much like a bullet or round designed to fit a particular weapon and be inserted into the weapon's barrel through the breech. The barrel plug 500 is preferably constructed of a silicone type material and is slightly over-sized such that once it is inserted into the barrel of the weapon, it cannot be easily removed except by utilizing a removal device such as a rod (not shown) inserted through the end of the weapon's barrel and utilized to push against the concave front surface 510 of the barrel plug 500 to push it out of the barrel into the breech.

One use for the barrel plug 500 according to the present invention is in the case of firearm retailers, firearm sellers or firearm owners, the barrel plug 500 may be inserted through the breach of a weapon into the barrel which then prevents the insertion of a real bullet. This is very important in a retail store setting where an individual acting as an interested purchaser could pick up a firearm and insert one or more bullets he or she has brought with them and use the now live weapon to harm or threaten the public in that retailer location or elsewhere.

One or more embodiments of the chamber safety device according to the present invention as shown in FIGS. 11 through 18 are designed primarily for automatic (sometimes termed semi-automatic) handguns. A semi-automatic pistol or handgun is a type of handgun which uses a single chamber and barrel, with a mechanism (slide) powered by the previous shot to eject a previously fired (spent" cartridge and to load a fresh cartridge into the chamber. One round is fired each time the trigger of a semi-automatic pistol is pulled. These embodiments described in the following paragraphs ensure that the weapon's chamber cannot be loaded with a live round and/or the weapon's "slide" designed to insert a live round into the weapons chamber is prevented from closing which could advance a round into the chamber. In addition and importantly, the chamber safety device can be installed on a handgun and left in place while the weapon is in a holster, in which case the chamber safety device remains visible (highly visible since it is constructed of a material having the same high-visibility characteristics described above) even when the weapon is holstered.

Figure 11:
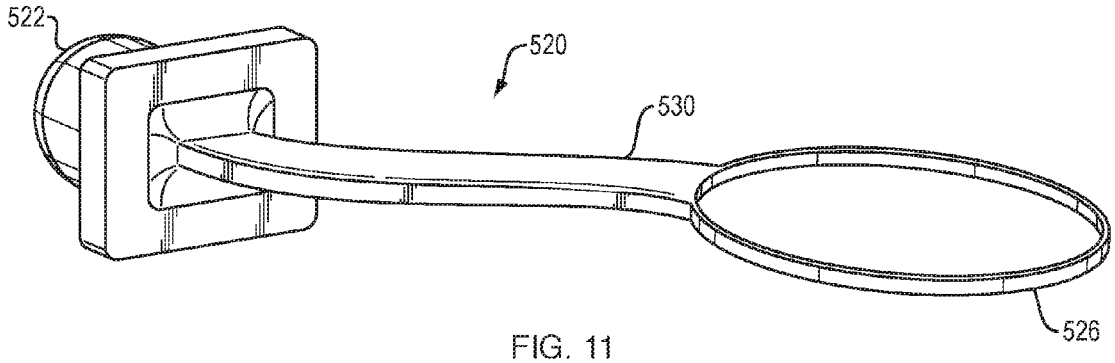
FIG. 11 is a new drawing of a first embodiment of a safety device according to the present invention for use with a semi-automatic weapon.
Figure 12A:
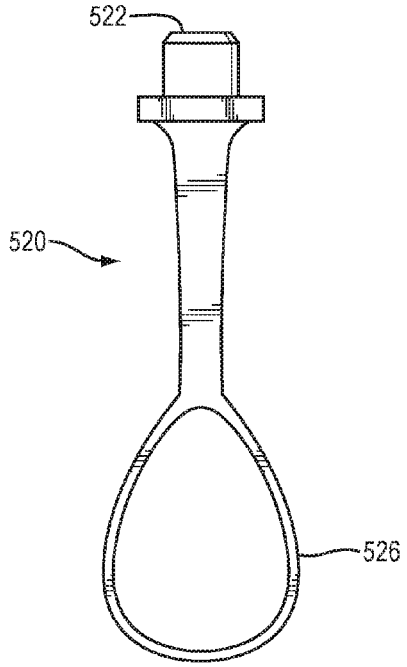
FIGS. 12A-12N illustrate yet another embodiment of the present invention for use with a semi-automatic weapon.
Figure 13:
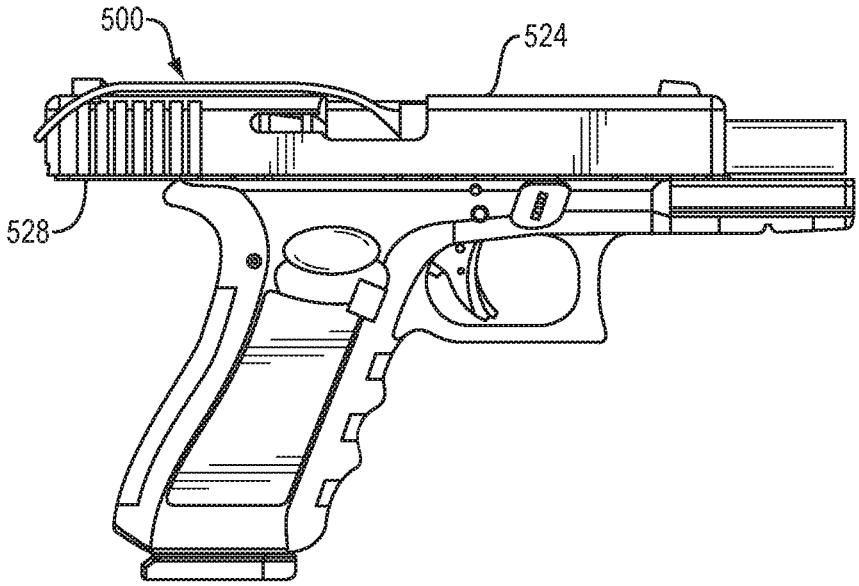
FIG. 13 is a drawing of the safety device of the present invention installed in a semi-automatic weapon.
Figure 14:
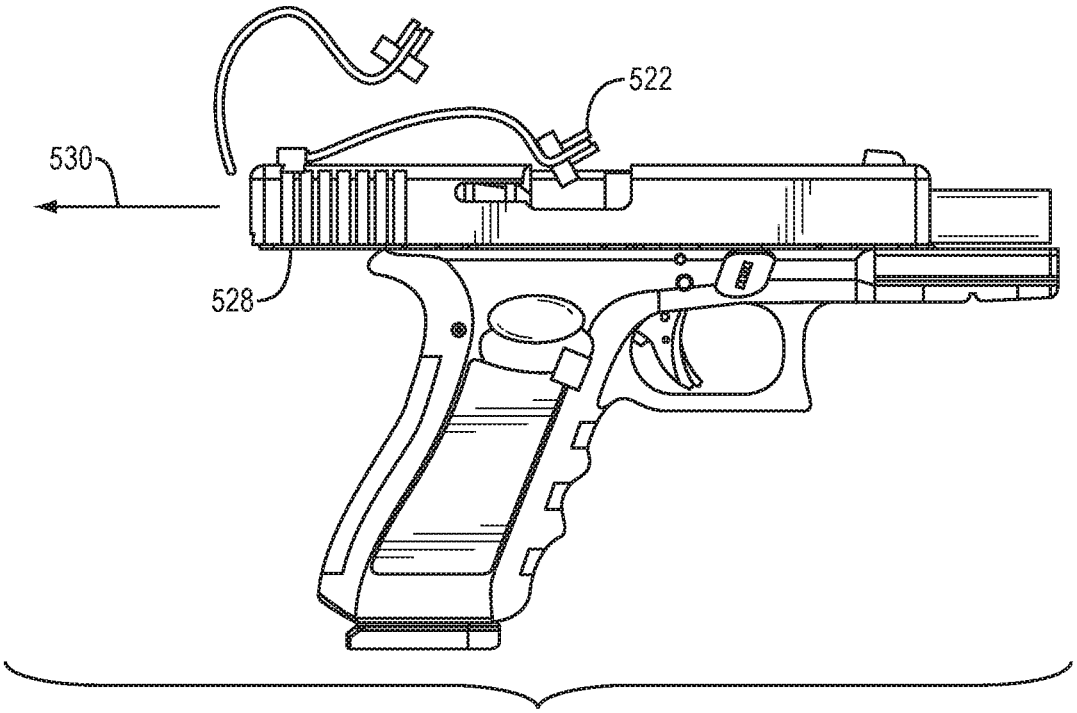
FIG. 14 is a drawing illustrating the release of the safety device of the present invention installed in a semi-automatic weapon upon the rearward activation of the slide mechanism.
Figure 15A:
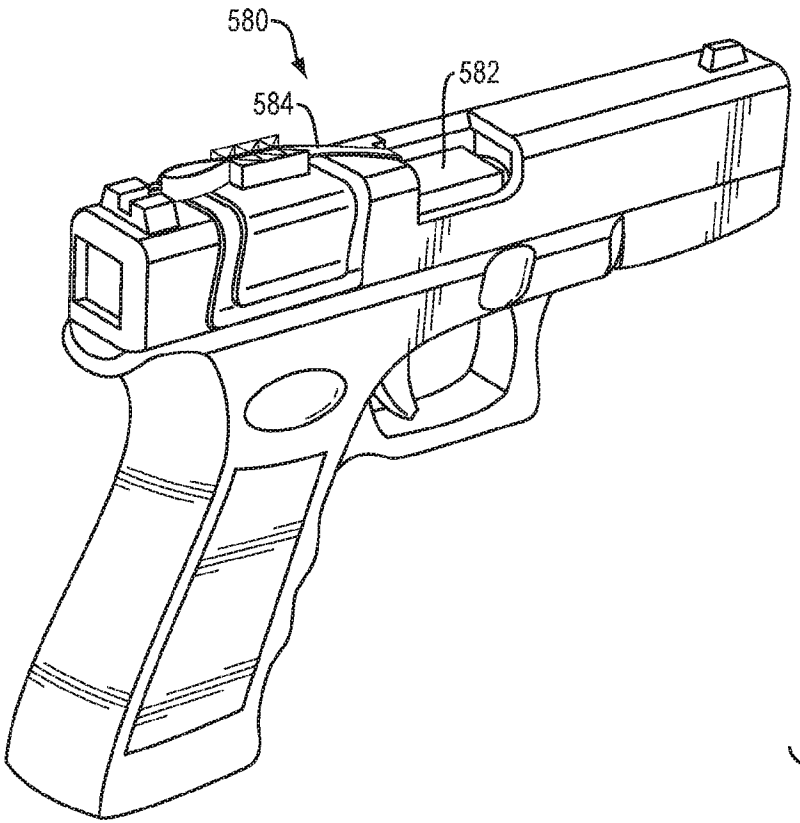
FIGS. 15A-15E illustrate yet another embodiment of the safety device of the present invention for use with a semi-automatic weapon.
Figure 15B:
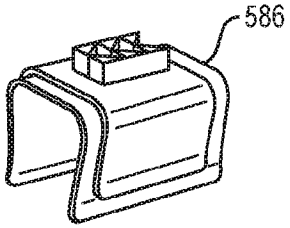
Figure 15C:
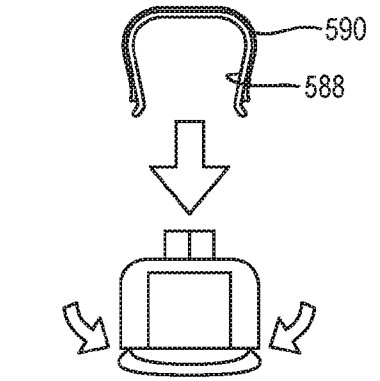
Figure 15D:
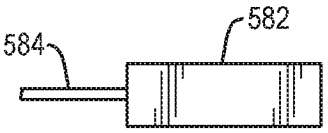
Figure 15E:
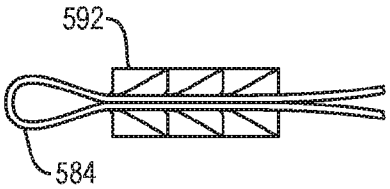

In the first embodiment of the invention designed for use with an automatic handgun, FIGS. 11 and 12A, the safety device 520 includes a generally circular shaped end 522 which is sized and designed to be inserted into the chamber of a weapon 524, FIG. 13. A second end 526 of the safety device 520 is formed as a circular loop designed to be stretched around the rear most portion of the slide mechanism 528 of the weapon 524. The safety device 500 and accordance with this embodiment is made from a soft or hard plastic with regards to the first end 522, while the second end 526 and the intermediary portion 530 connecting the first end 522 and the second end 526 is made from a stretchable elastomeric type material. When the user is ready to fire the weapon and load the chamber with a live round of ammunition, the user pulls back on the slide which causes the first end 522 to be pulled out of the chamber by virtue of the motion of the slide 528 moving in the direction shown by arrow 530, FIG. 14.

Figure 12B:
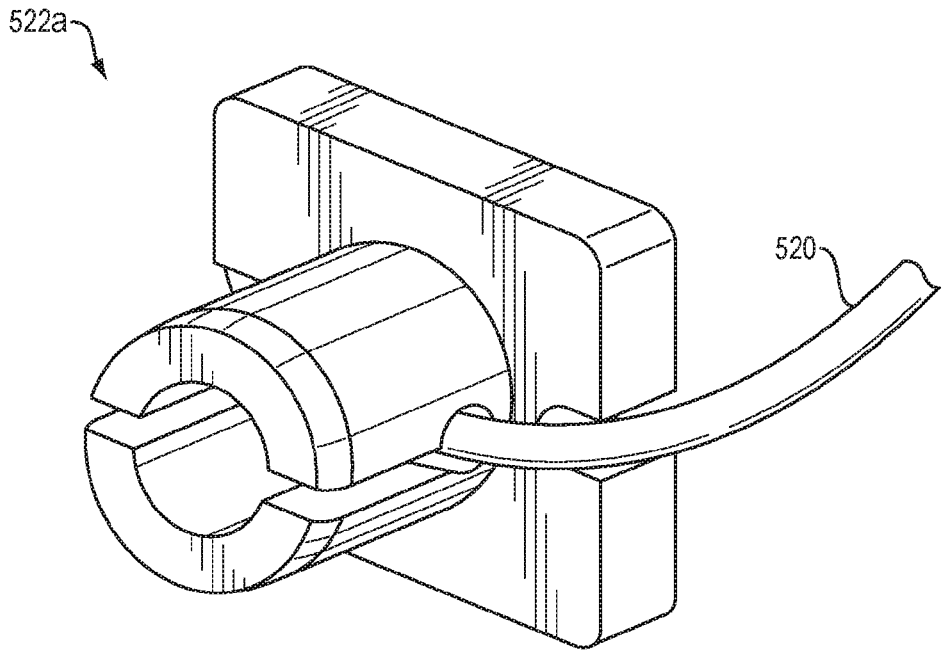
Figure 12C:
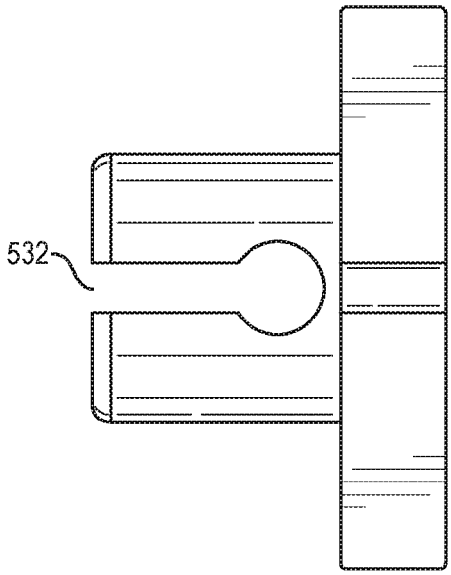
Figure 12D:
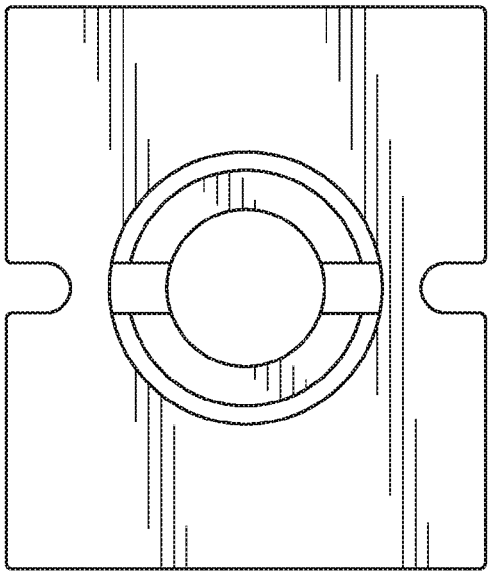

In another version of this type of embodiment according to the invention, the first end portion 522*a*, FIG. 12B-12D, may be a separate piece made of hard or soft rubber. A separate elastic portion 520 and end loop as shown in FIGS. 11 and 12A may be provided to slide into the slot 532 provided in the first end portion 522*a* while the second end portion (not shown but similar to the second end portion 526 in FIG. 11) loops around the end of the slide 528 as shown in FIG. 13.

Figure 12E:
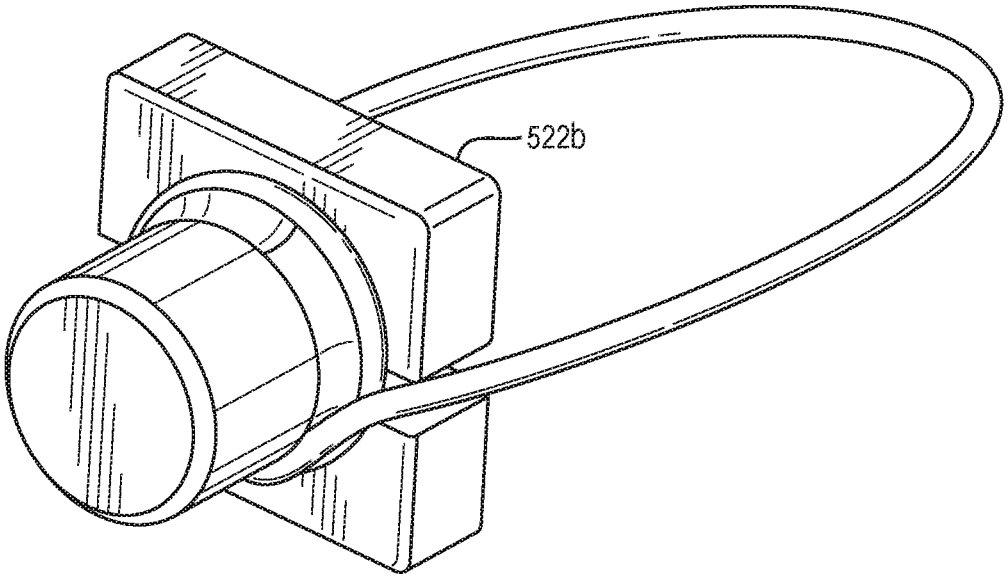
Figure 12F:
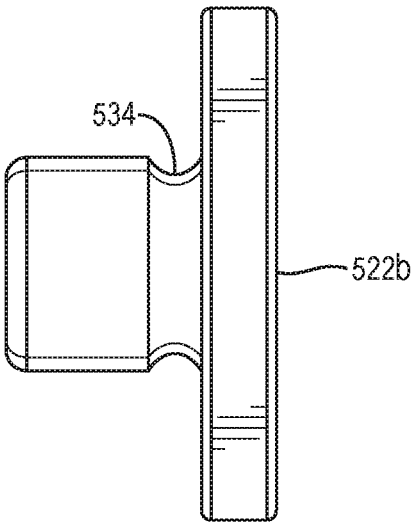

In another version of this type of embodiment according to the present invention shown in FIGS. 12E and 12F, the first and plug 522*b*, FIGS. 12E and 12F includes a notch or recess 534 into which may be looped a single piece of high visibility elastic material which in turn can be looped around the end of the slide of an automatic weapon as discussed above.

Figure 12G:
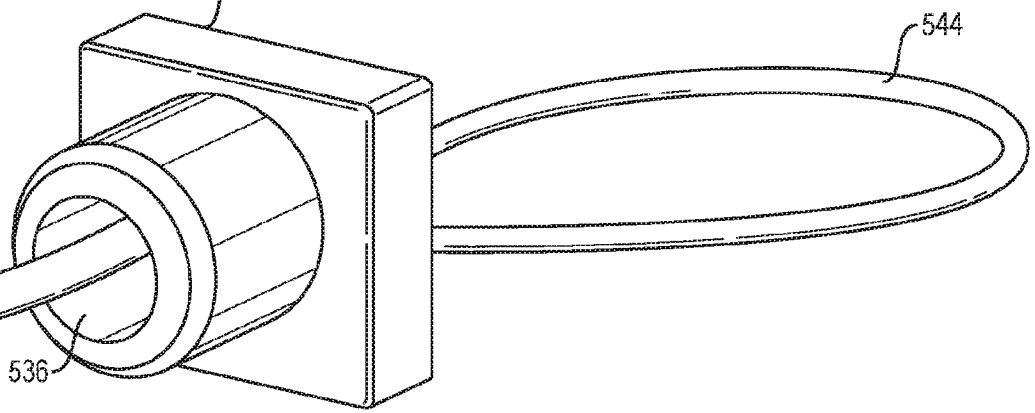
Figure 12H:
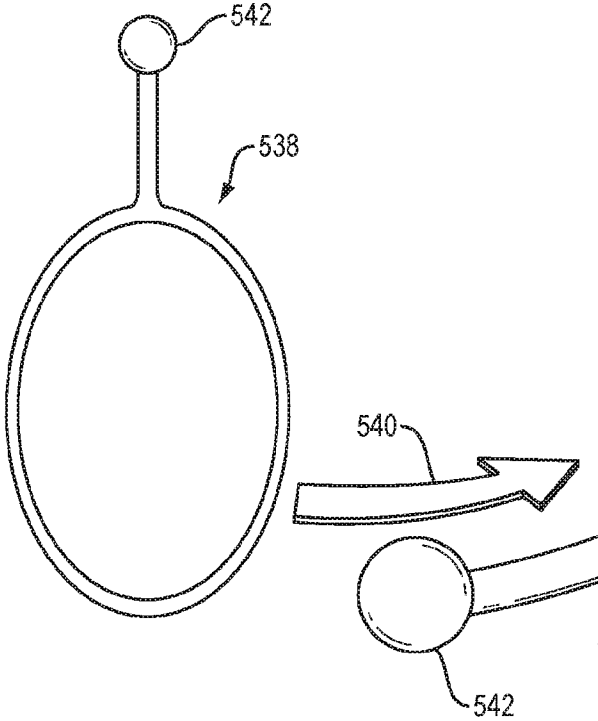
Figure 12I:
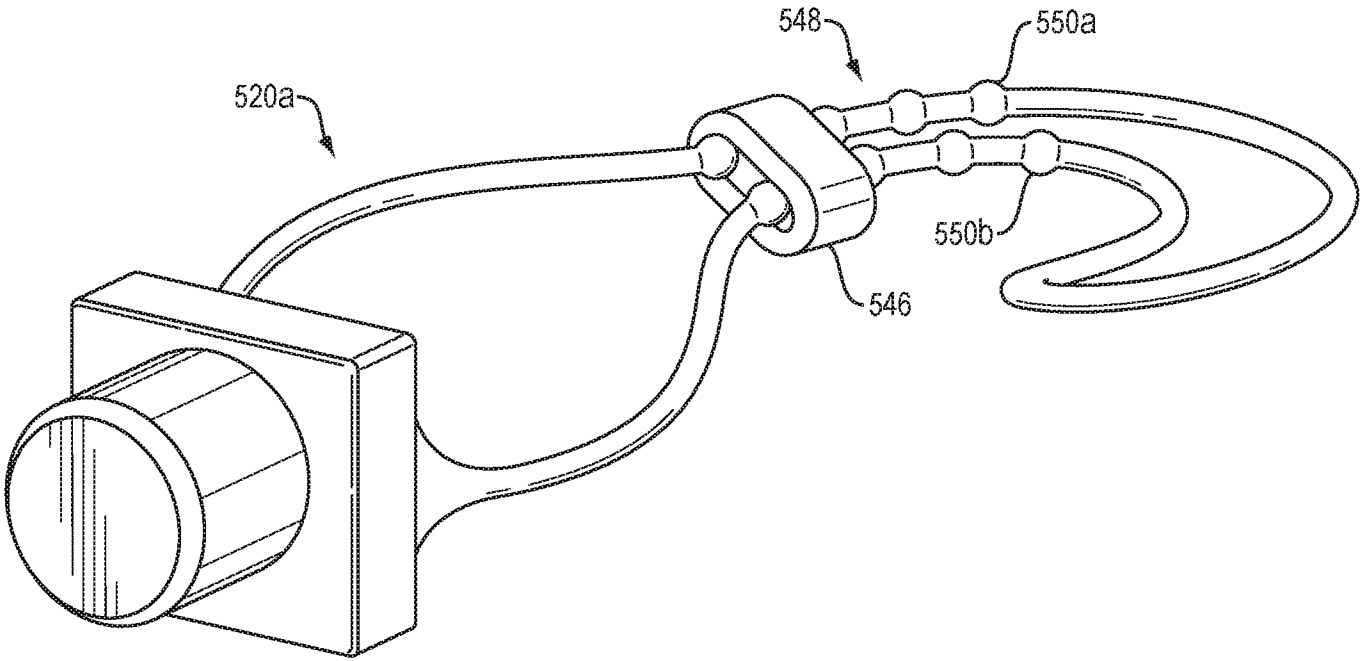

In another embodiment shown in FIGS. 12G and 12H, the first and portion 522*c* is provided with a whole or aperture 536 through which an elastic portion 538 may be inserted in the direction shown by arrow 540. The ball 542 at the end of the loop 538 keeps the elastic in place while the second end of the loop 544 is configured to wrap around the slide of and automatic handgun as described above.

The safety device shown in FIG. 121 is similar to that described above with the addition of a slide or element 546 which is sized and configured to slip over that portion of the elastic loop 548 having a plurality of circular balls 550 which allow the loop of the safety device to be adjusted in size (length) depending on the type of weapon with which the safety device 520*a* is utilized.

Figure 12J:
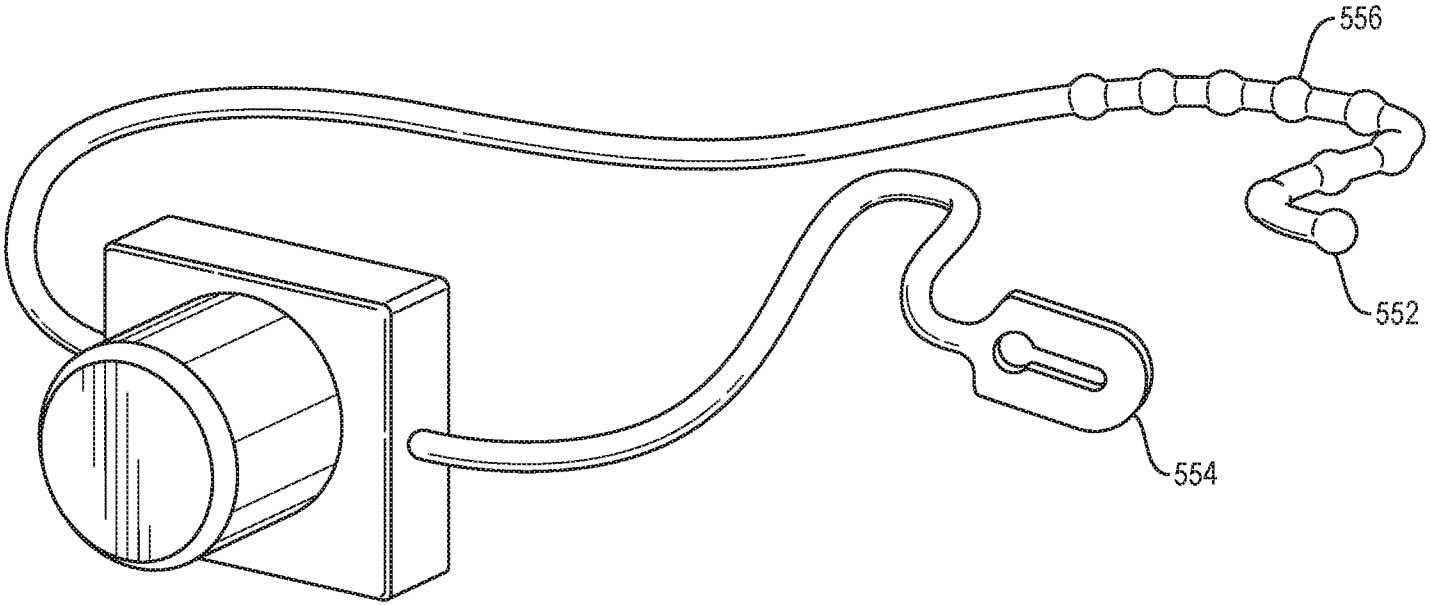

In yet another embodiment shown in FIG. 12J, the elastic portion includes first and second free ends 552, 554. The first free end 552 includes a plurality of generally evenly spaced balls 556 which are designed to be retained in the clasp portion 554 of the second end of the loop. In this manner, the total loop size can be adjusted based upon the size of the weapon on which the safety device is being installed.

Figure 12L:
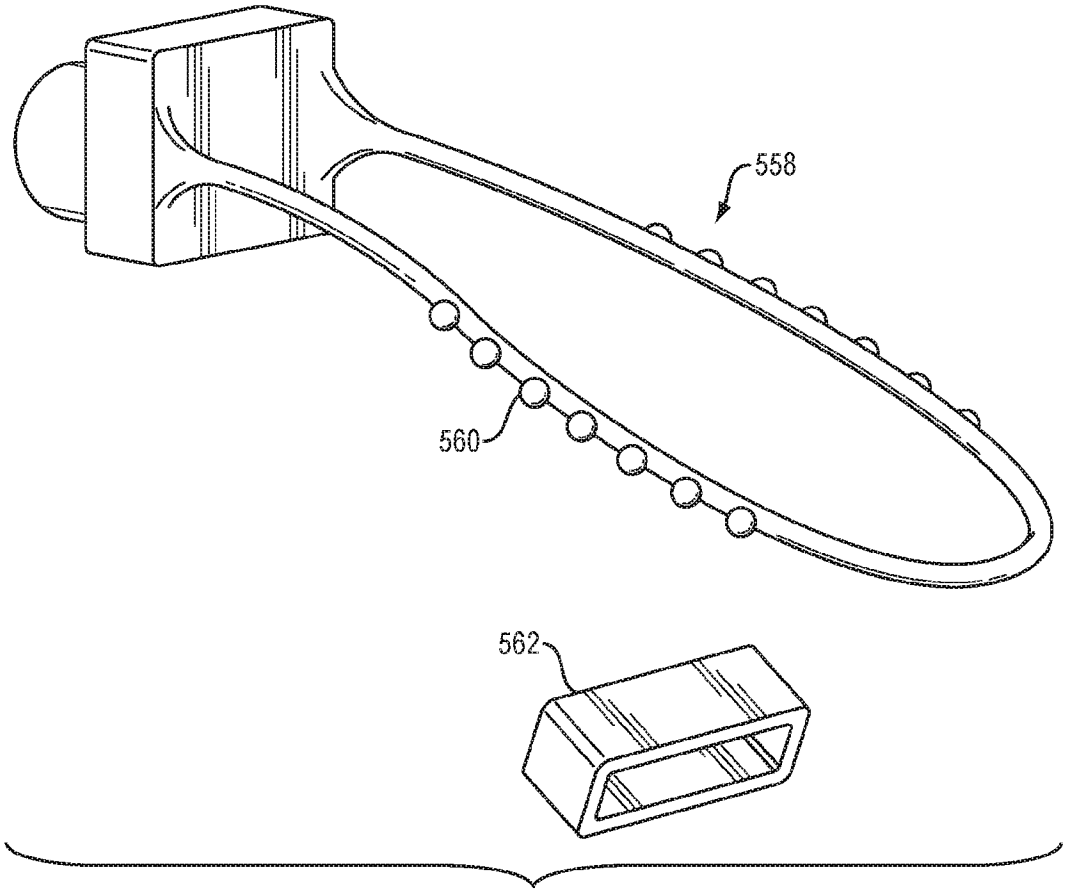
Figure 12K:
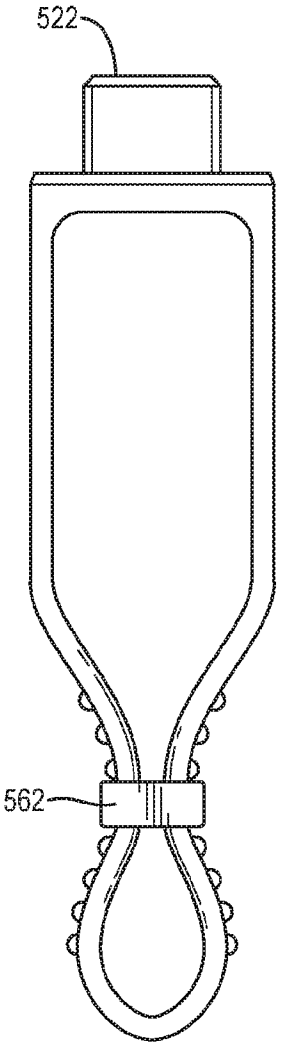

In a similar fashion, the loop 558 as shown in FIGS. 12K and 12L include a number of small protrusions or stops 560 which, combined with the slider adjuster 562, allows the size of the loop between the first end portion 522 and the second end portion 526 formed by the slider 562 to be adjusted based upon the size of the weapon.

Figure 12N:
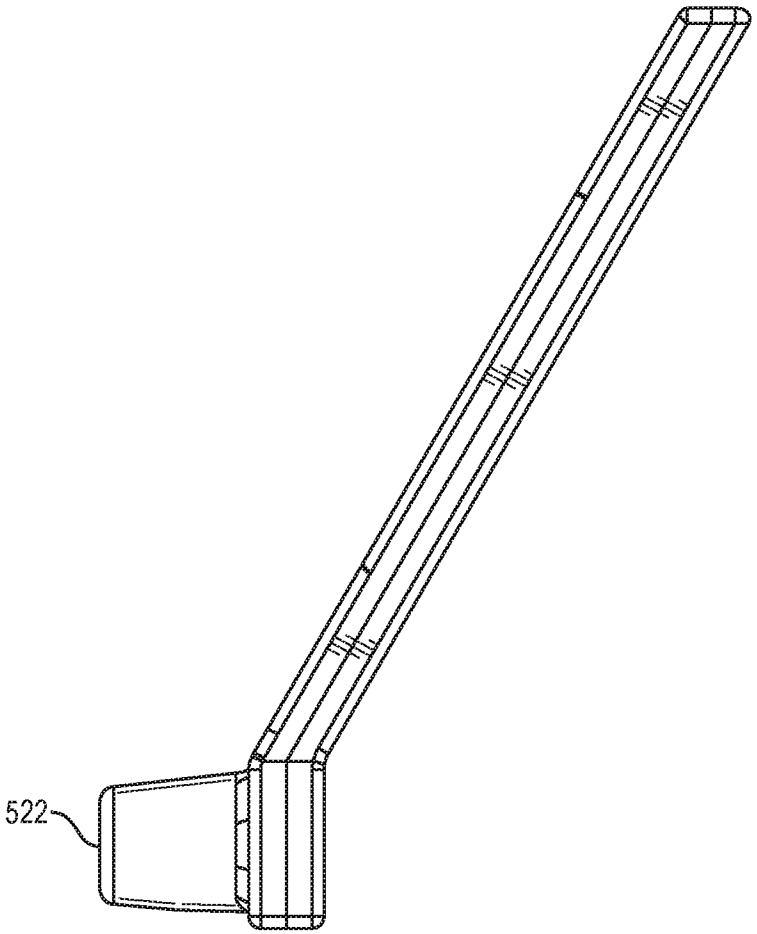
Figure 12M:
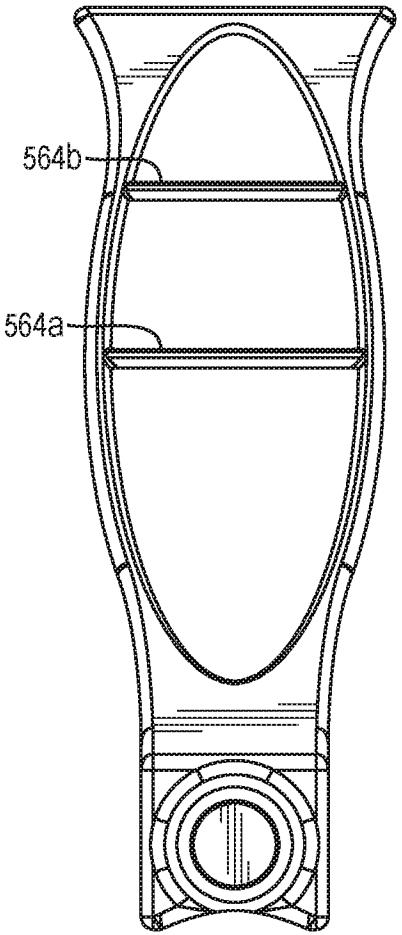

In yet another embodiment of this feature of the invention as shown in FIGS. 12M and 12N, the safety device may be made is a one piece safety device 520 having a first end 522 designed to be inserted into the chamber of a weapon and a second and that is adjustable and length by selecting one or more of the elastic cross pieces 564.

In yet another embodiment of the safety device for use with an automatic handgun in accordance with the teachings of the present invention, the safety device 580 shown in FIG. 15 includes a first portion 582 which is sized and designed to be inserted into the weapon's open between the slide and the barrel of the weapon. An elastic portion 584 is attached at or proximate one end of the first portion 582. This elastic portion 584 is held in place by a retaining clip 586, FIG. 15B. The retaining clip 586 is fashioned out of a base in urethane material 588 over which is inserted a pre-bent spring steel "clip" 590. The retaining clip is slid over the slide of the automatic handgun as shown in FIG. 15A. A top portion or region of the retaining clip 586 includes a region 592 including a number of closely spaced elements into which may be stretched the elastic portion 584 and retained by the closely spaced elements in the top region 592 and allows the user to stretch that the elastic portion 584 with the appropriate amount of tension such that when the user draws back the slide mechanism, the first portion 582 will be pulled out of the chamber as previously discussed.

Figure 16B:
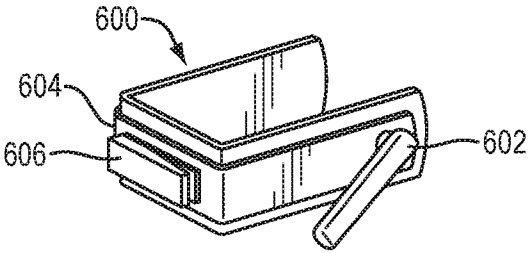
FIGS. 16A-16C illustrate yet an additional embodiment of the safety device of the present invention for use with a semi-automatic weapon.
Figure 16C:
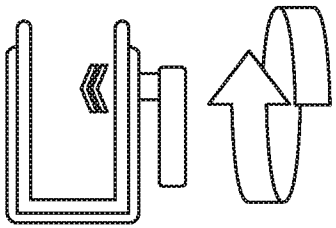
Figure 16A:
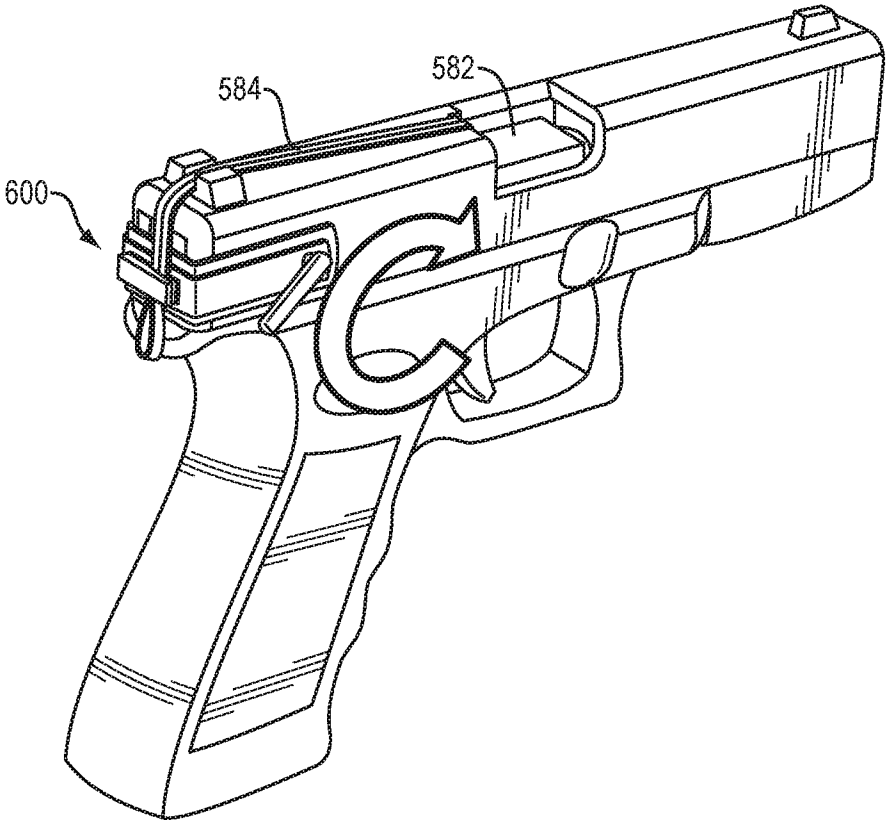
Figure 17B:
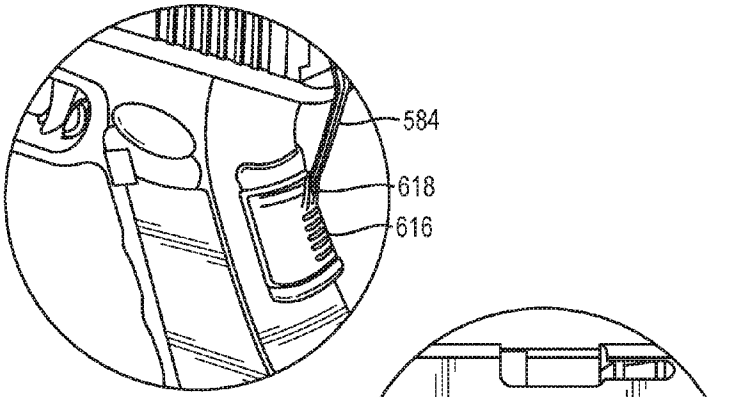
FIGS. 17A-17D illustrate a further embodiment of the safety device of the present invention for use with a semi-automatic weapon.
Figure 17C:
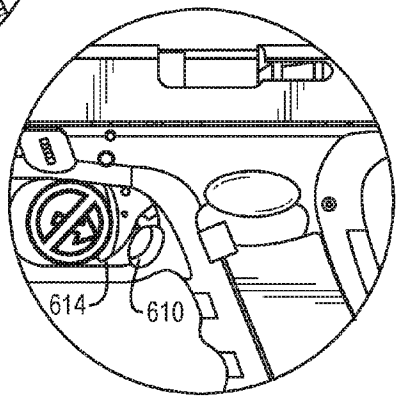
Figure 17D:
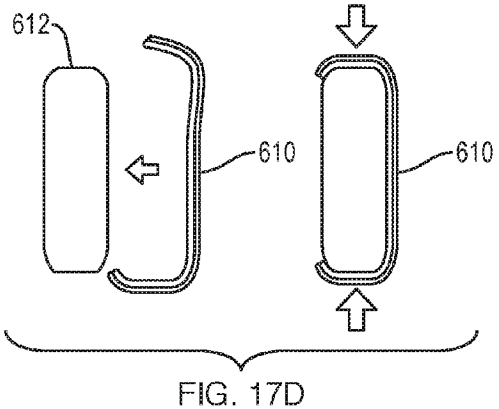
Figure 17A:
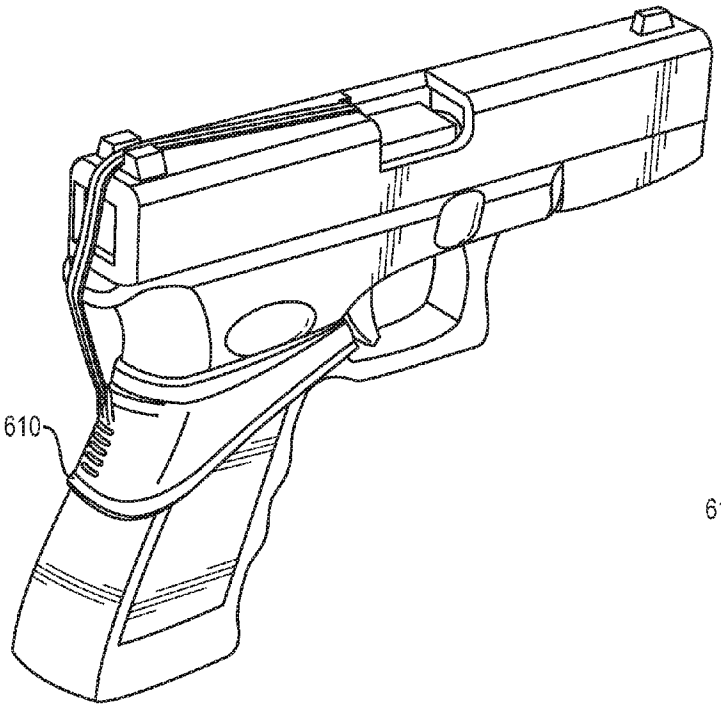

Another embodiment of the retaining clip 600 is shown in FIG. 16 which is constructed from a base urethane member over which is provided a spring steel clip. In addition, in this embodiment a turnable fastening element 602 is provided which engages with the spring steel portion and allows the user to tighten the engagement of the retaining clip 600 onto the slide of the weapon. The rear most portion of the retaining clip 600 includes a wedge shaped grip element 606 through which the elastic portion 584 of the safety device may be inserted and held in place. In use, moving the slide away from the weapon places tension on the elastic 584 which in turn "pulls out" the first portion 582 from the chamber of the weapon.

In another embodiment of the present invention, a generally U-shaped clamp 610, FIG. 17, may be provided which is intended to clip around the handle portion 612 of the handgun and arrest behind the trigger 614. The rear most portion 616 of the U-shaped clamp 610 includes a number of slots through two of which may be threaded and secured 1 and 618 of the elastic 584. Operation and ejection of the safety device is as previously described with regards to other embodiments for automatic handguns.

Figure 18B:
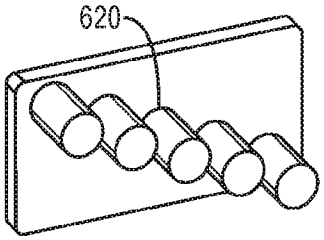
FIGS. 18A-18C illustrate yet an additional embodiment of the safety device of the present invention for use with a semi-automatic weapon.
Figure 18C:
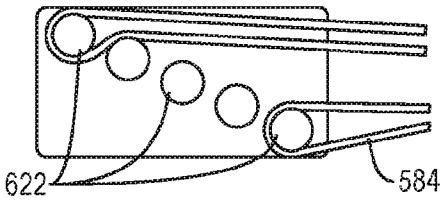
Figure 18A:
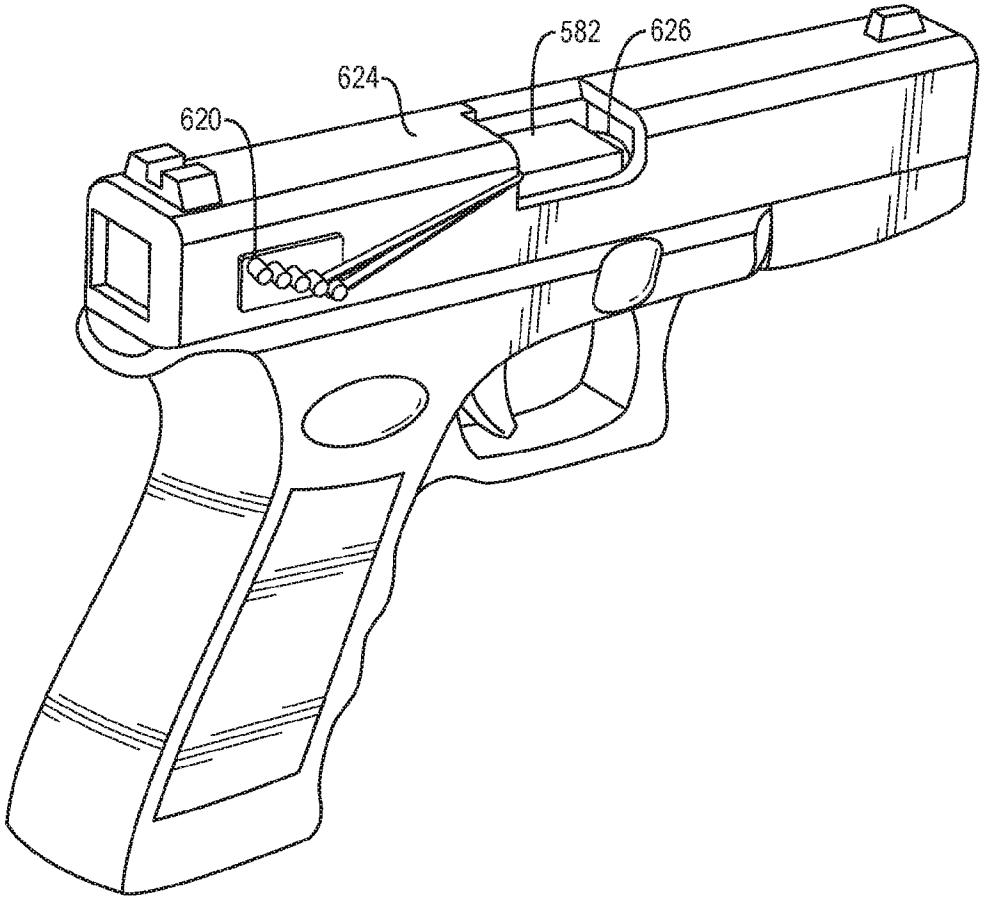

In yet another embodiment of the present invention, an anchoring device 620, FIG. 18, is a urethane member that is adhesively applied to the side of the slide of the handgun. The anchoring device 620 is provided with a number of posts 622 around which may be threaded the end of the elastic that is coupled to the portion 582 of the safety device that is inserted into the chamber of the handgun between the slide 584 in the barrel 586. The amount of tension on the elastic 584 may be adjusted by selecting the appropriate post 622 around which the elastic 584 is placed. Operation of this embodiment is as previously described.

Figure 19B:
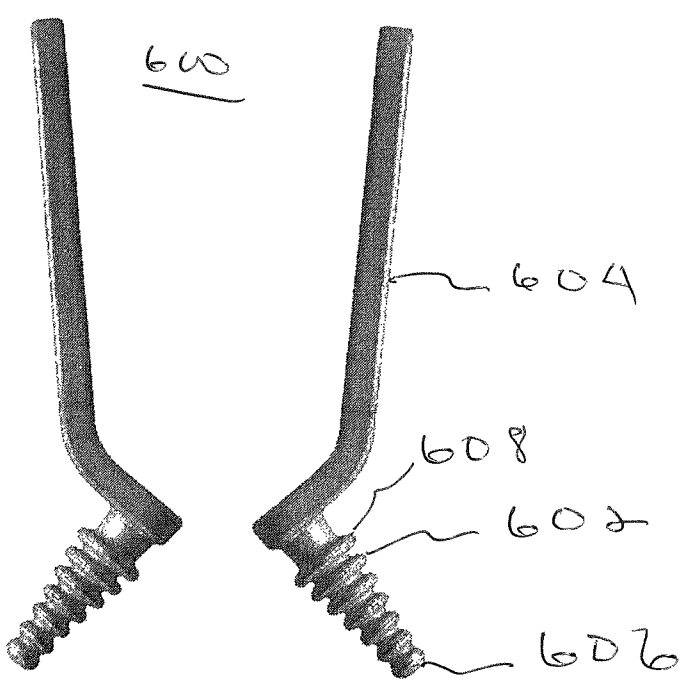
FIGS. 19A and 19B illustrate yet an additional embodiment of the safety device of the present invention for use as a generally universal empty chamber indicator.
Figure 19A:
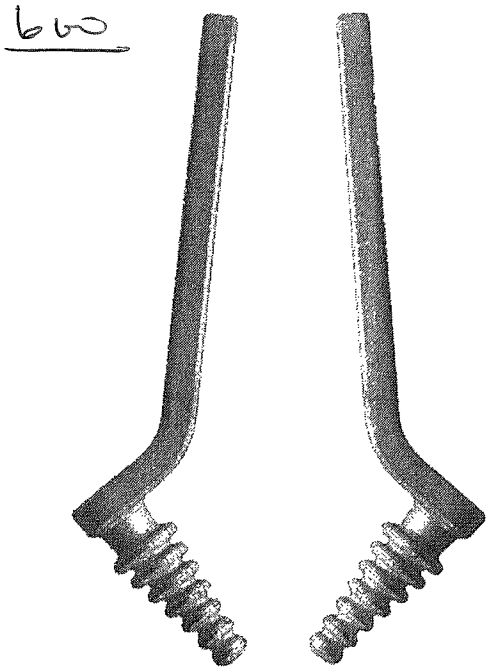

FIGS. 19A and 19B illustrate a universal Empty chamber indicator (ECI) 600. The universal ECI is designed to fit most manual and semi-automatic handguns as well as many rifles and shotguns. Much like the other embodiments described herein, the universal ECI is made from 100% ultra-durable, highly visible blaze orange (or other high visibility color) silicone, and provides instant visual recognition that a firearm is safe by indicating a fully open action to surrounding shooters, range personnel and observers. In addition to enhancing the shooter safety by aiding against accidental closure of the action, the universal ECI helps preserve a firearms performance by preventing elements like debris or dust from contaminating the barrel.

The universal ECI 600 includes a first portion 602 which is designed to be inserted into the barrel of a weapon through the breach area as well as a pull tag 604 which serves to remove the universal ECI from the weapon while at the same time and most importantly providing a highly visual and visible indication that the firearm is in a safe condition and cannot be fired or discharged. The first portion 602 is comprised of a number of concentric rings of silicone material which get progressively larger in circumference from the smaller and region 606 to the larger region 608. The concentric rings may range in size from approximately ¼ inch to ½ inch or larger in diameter.

To use the universal ECI according to this embodiment of the invention, the user simply press fits the first or barrel portion 602 into the breach end of the barrel of the firearm and leaves the tab portion 604 extending outward from the breach. To remove the device from the barrel of the firearm, the user simply pulls on the tab portion 604 thus pulling the first and portion 602 out of the barrel of the firearm.

Accordingly, the present invention provides a simple, inexpensive and easy to use device that functions to block the firing ability of shotguns, rifles, handguns or any other weapon and to provide an identifiable visual indicator to the user and most importantly to others in the general area that the weapon is in a "safe" mode cannot be fired or accidentally discharge.

Modifications and substitutions by one of ordinary skill in the art are considered to be within the scope of the present invention, which is not to be limited except by the allowed claims and their legal equivalents.

The invention claimed is:

1. A chamber safety device for an opening in or proximate a breech in a weapon, said weapon including an action movable from an open non-armed position to a closed armed position, said chamber safety device comprising:

an handle portion having a length and a width, said handle portion configured for extending conspicuously out of and to the exterior of an opening of a weapon proximate a breech of said weapon, such that at least said handle portion remains continuously conspicuous to others in the area of said weapon proximate said breech when said chamber safety device is inserted into said opening in said weapon, wherein at least said handle portion is colored in a high visibility color, said high visibility color having a wavelength of greater than 492 nm; and a barrel portion having a length and a width, wherein the lower portion is configured for configured for being inserted into a barrel of said weapon through said breech and for frictionally engaging with at least an opening of said barrel proximate said breech of said weapon without mechanical actuation, said barrel portion comprising a varying, tapered width, said varying tapered width including a smaller diameter proximate a first end of said barrel portion of said chamber safety device and a larger diameter proximate a second end of said barrel portion of said chamber safety device, said handle portion of said chamber safety device coupled to said barrel portion proximate said second end of said barrel portion, and wherein in use, said barrel portion is configured for preventing said weapon action from moving from said open non-armed position to said closed armed position and for preventing a weapon ammunition round from being inserted into said breech end of a weapon barrel.

2. The chamber safety device of claim 1, wherein said high visibility color is a hunter orange color.

3. The chamber safety device of claim 1, wherein said chamber safety device is entirely constructed from a resilient material.

4. The chamber safety device of claim 3, wherein said resilient material is silicone.

5. The chamber safety device of claim 1, wherein at least said barrel portion this constructed from a material configured to retain a lubricant.

6. The chamber safety device of claim 1, wherein said high visibility color is selected from the group consisting of green, yellow/green, yellow, orange and red.

7. The chamber safety device of claim 1, wherein said barrel portion comprises a plurality of rings, each of plurality a rings having a varying diameter.

* * * * *